US012215901B2

(12) United States Patent
Stark et al.

(10) Patent No.: US 12,215,901 B2
(45) Date of Patent: Feb. 4, 2025

(54) GUIDING PANEL FOR CONDENSER, CONDENSER AND REFRIGERATION SYSTEM

(71) Applicant: Carrier Corporation, Palm Beach Gardens, FL (US)

(72) Inventors: Michael A. Stark, Mooresville, NC (US); Scott A. Nieforth, Clay, NY (US); Kai Deng, Shanghai (CN); Haiping Ding, Shanghai (CN); Yuling Shi, Shanghai (CN); HongYi Li, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 18/483,290

(22) Filed: Oct. 9, 2023

(65) Prior Publication Data

US 2024/0035720 A1 Feb. 1, 2024

Related U.S. Application Data

(60) Division of application No. 17/236,414, filed on Apr. 21, 2021, now Pat. No. 11,821,665, which is a (Continued)

(30) Foreign Application Priority Data

Jan. 16, 2018 (CN) ..... 201820068695.0

(51) Int. Cl.
*F25B 39/04* (2006.01)
*F28D 3/02* (2006.01)
(Continued)

(52) U.S. Cl.
CPC ..... *F25B 39/04* (2013.01); *F28D 3/02* (2013.01); *F28F 9/026* (2013.01); *F28F 9/22* (2013.01);
(Continued)

(58) Field of Classification Search
CPC ..... F25B 39/04; F25B 2339/04; F25B 2339/046; F25B 2500/12; F25B 2500/13;
(Continued)

(56) References Cited

U.S. PATENT DOCUMENTS 2,111,133 A 3/1938 Zwickl
2,111,570 A 3/1938 Neeson
(Continued)

FOREIGN PATENT DOCUMENTS

CN 2739556 Y 11/2005
CN 2890783 Y 4/2007
(Continued)

OTHER PUBLICATIONS

European Search Report for application 19151521.2, dated Jun. 19, 2019, 7 pages.

*Primary Examiner* — Emmanuel E Duke
(74) *Attorney, Agent, or Firm* — CANTOR COLBURN LLP

(57) ABSTRACT

A deflector for a condenser. The condenser has an inlet in communication with a compressor, and a deflector for guiding a refrigerant gas flow from the compressor is arranged in the condenser and at a position close to the inlet. The deflector is provided with a deflecting structure projecting toward the inlet, and the deflecting structure is configured as impermeable to the refrigerant gas flow.

7 Claims, 5 Drawing Sheets

Related U.S. Application Data continuation of application No. 16/249,117, filed on Jan. 16, 2019, now Pat. No. 11,098,934.

(51) Int. Cl.
*F28F 9/02* (2006.01)
*F28F 9/22* (2006.01)

(52) U.S. Cl.
CPC ..... *F25B 2339/04* (2013.01); *F25B 2339/046* (2013.01); *F25B 2500/12* (2013.01); *F25B 2500/13* (2013.01); *F28F 2265/28* (2013.01); *F28F 2265/30* (2013.01)

(58) Field of Classification Search
CPC ..... F28D 3/02; F28F 9/026; F28F 9/22; F28F 2265/28; F28F 2265/30
See application file for complete search history.

(56) References Cited

U.S. PATENT DOCUMENTS

| | | | | |
|---|---|---|---|---|
| 4,194,371 | A | 3/1980 | Morse | |
| 4,928,524 | A | 5/1990 | Sugi et al. | |
| 5,122,352 | A * | 6/1992 | Johnson | B01J 8/12 423/243.12 |
| 5,465,783 | A | 11/1995 | O'Connor | |
| 6,868,695 | B1 | 3/2005 | Dingel et al. | |
| 8,276,653 | B2 | 10/2012 | Al-Anizi et al. | |
| 8,944,152 | B2 | 2/2015 | Kulankara et al. | |
| 2003/0192339 | A1 * | 10/2003 | Macbain | F16L 43/001 138/37 |
| 2005/0039587 | A1 | 2/2005 | Gorun et al. | |
| 2005/0115248 | A1 | 6/2005 | Koehler et al. | |
| 2010/0326108 | A1 | 12/2010 | Schreiber et al. | |
| 2011/0024080 | A1 | 2/2011 | Bose et al. | |
| 2015/0292804 | A1 | 10/2015 | Hermida et al. | |
| 2019/0219314 | A1 | 7/2019 | Stark et al. | |
| 2021/0239372 | A1 | 8/2021 | Stark et al. | |

FOREIGN PATENT DOCUMENTS

| | | | |
|---|---|---|---|
| CN | 202328931 | U | 7/2012 |
| CN | 202547472 | U | * 11/2012 |
| CN | 202928219 | U | 5/2013 |
| CN | 202973672 | U | 6/2013 |
| CN | 203478730 | U | 3/2014 |
| CN | 203964462 | U | 11/2014 |
| CN | 104764258 | A | 7/2015 |
| CN | 104833140 | A | 8/2015 |
| CN | 205227950 | U | 5/2016 |
| CN | 105823353 | A | 8/2016 |
| CN | 206073517 | U | 4/2017 |
| CN | 106642833 | A | 5/2017 |
| CN | 107062709 | A | 8/2017 |
| EP | 1426565 | A1 | 6/2004 |
| JP | S59170697 | A | 9/1984 |

* cited by examiner

GUIDING PANEL FOR CONDENSER, CONDENSER AND REFRIGERATION SYSTEM

PRIORITY

This application is a divisional of U.S. patent application Ser. No. 17/236,414, filed Apr. 21, 2021, which is a continuation of U.S. patent application Ser. No. 16/249,117, filed Jan. 16, 2019, which claims priority to Chinese Patent Application No. 201820068695.0, filed Jan. 16, 2018, and all the benefits accruing therefrom under 35 U.S.C. § 119, the contents of which in their entirety are herein incorporated by reference.

TECHNICAL FIELD

The present utility model relates to the technical field of heat exchange equipment, and particularly to a deflector for a condenser, a condenser having the deflector for a condenser, and a refrigeration system equipped with the condenser.

BACKGROUND ART

It is known to those skilled in the art that the condenser is one type of heat exchange equipment. In a refrigeration system consisting of basic components such as a compressor, a condenser, a throttle valve, and an evaporator, a refrigerant continuously circulates and flows in the system and exchanges heat with the outside by means of its phase change. The compressor compresses a working medium from a low-temperature low-pressure gas into a high-temperature high-pressure gas, which is then condensed into a medium-temperature high-pressure liquid through the condenser.

Currently, a deflector 14 is mounted inside a shell of a condenser as shown in FIG. 1 and at a position corresponding to a refrigerant gas inlet 13, to reduce the impact force of a high-temperature high-pressure gas from a discharge pipe 12 of the compressor. The deflector 14 is usually in the form of a flat plate, as shown in FIG. 1 and FIG. 2. When the refrigerant gas flow discharged from the compressor goes through the deflector 14, the huge impact force of the gas flow generally causes the entire condenser to vibrate violently and produces unexpected noise. In addition, because the deflector 14 is arranged inside the shell of the refrigerant gas inlet of the condenser in the form of a flat plate, the space inside the condenser is not fully used.

Therefore, it is necessary to provide a deflector for a condenser, which not only can reduce the impact force of the refrigerant gas flow, but also can reduce vibration and noise.

SUMMARY

In view of this, a first aspect of the present utility model provides a deflector for a condenser, so as to effectively solve the above-mentioned problems of the prior art and other problems. In the deflector for a condenser according to the present utility model, the condenser has an inlet in communication with a compressor, and a deflector for guiding a refrigerant gas flow from the compressor is arranged in the condenser and at a position close to the inlet, wherein the deflector is provided with a deflecting structure projecting toward the inlet, and the deflecting structure is configured as impermeable to the refrigerant gas flow.

In another embodiment of the deflector for a condenser according to the present utility model, the deflecting structure includes a first side plate, a second side plate, and a top plate, the first side plate and the second side plate are arranged on two sides of the top plate respectively, and the top plate projects toward the inlet relative to the first side plate and the second side plate.

In another embodiment of the deflector for a condenser according to the present utility model, the first side plate and the second side plate are of the same size and are symmetrically arranged on the two sides of the top plate respectively.

In still another embodiment of the deflector for a condenser according to the present utility model, the deflecting structure is configured as a wavy cross section with peaks and troughs, and at least one peak points to the inlet.

In another embodiment of the deflector for a condenser according to the present utility model, the deflecting structure has a triangular cross section, the deflecting structure has a first side plate and a second side plate, and the first side plate and the second side plate are of the same size and are symmetrically arranged on the deflector.

In still another embodiment of the deflector for a condenser according to the present utility model, the deflecting structure has a truncated spherical cross section.

In yet another embodiment of the deflector for a condenser according to the present utility model, the deflecting structure is arranged on the entire surface of the deflector.

In another embodiment of the deflector for a condenser according to the present utility model, the deflecting structure is made of steel.

In still another embodiment of the deflector for a condenser according to the present utility model, the deflecting structure is fixed to a housing of the condenser by welding.

In addition, a second aspect of the present utility model provides a condenser, including the above-mentioned deflector for a condenser.

In addition, a third aspect of the present utility model provides a refrigeration system including the above-mentioned condenser.

It should be understood that the deflector for a condenser according to the present utility model not only can effectively alleviate the impact of the high-temperature high-pressure gas flow from the compressor, but also can help reduce the vibration of the condenser and noise when the condenser runs. In addition, the deflector for a condenser according to the present utility model makes maximum use of the space inside the condenser.

BRIEF DESCRIPTION OF THE DRAWINGS

The technical solutions of the present utility model will be further described in detail below with reference to the accompanying drawings and embodiments, wherein.

DETAILED DESCRIPTION

Several embodiments of the present utility model will be described in detail below with reference to the accompanying drawings. It should be noted that orientational terms such as up, down, left, right, front, rear, inner side, outer side, top, and bottom, which are or may be mentioned in this specification, are defined in combination with the structures shown in the accompanying drawings. They are relative concepts, and therefore may change according to different positions and different usage states. Therefore, these or other orientational terms should not be construed as limiting terms.

Figure 1:
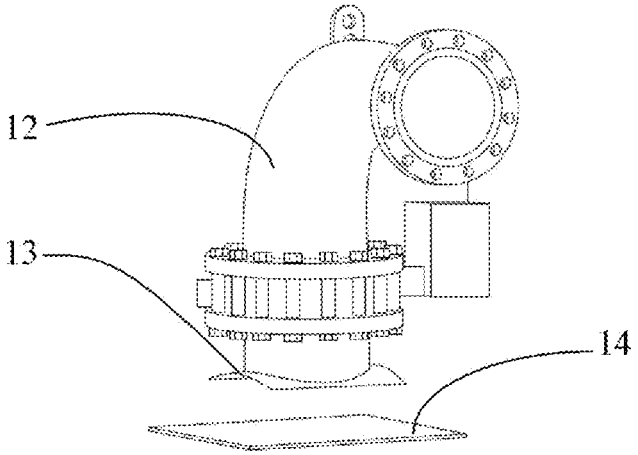
FIG. 1 is a three-dimensional partially-enlarged diagram of a deflector for a condenser in the prior art.
Figure 2:
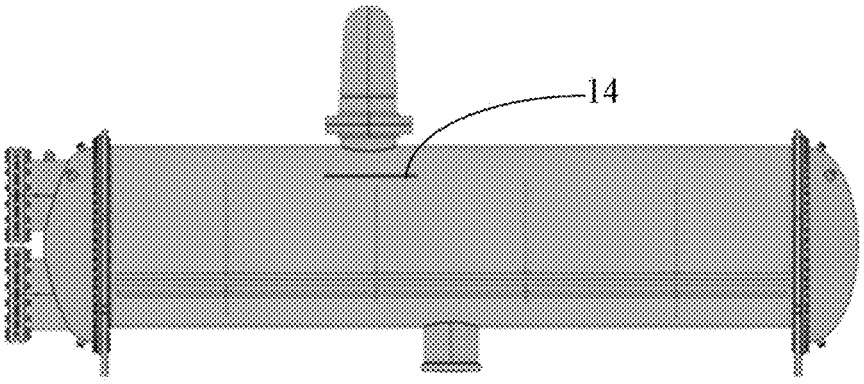
FIG. 2 is a schematic structural diagram of a condenser including the deflector for a condenser in FIG. 1.
Figure 3:
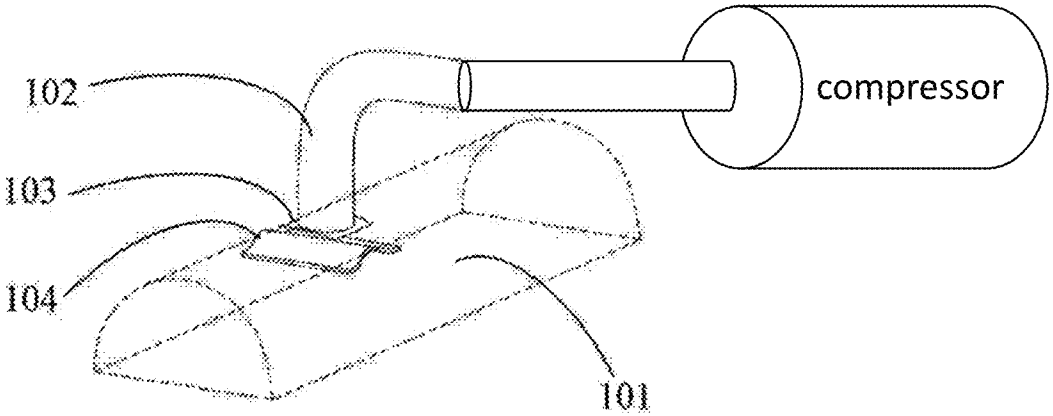
FIG. 3 is a three-dimensional schematic structural diagram of a deflector for a condenser according to a first embodiment of the present utility model.

As shown in FIG. 3, in general, the structure of a deflector for a condenser according to an embodiment of the present utility model is schematically shown. As can be clearly seen from FIG. 3, the condenser 101 has an inlet 103 in communication with a discharge pipe 102 of a compressor (not shown), and a deflector 104 for guiding a refrigerant gas flow from the compressor is arranged in the condenser 101 and at a position close to the inlet 103. The deflector 104 is fixed to a housing of the condenser 101 by welding or other means.

Figure 4:
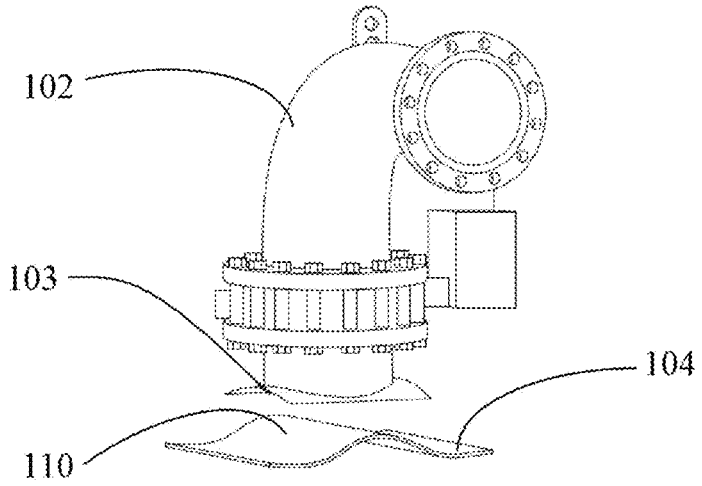
FIG. 4 is a partially-enlarged schematic diagram of the deflector for a condenser in FIG. 3.
Figure 5:
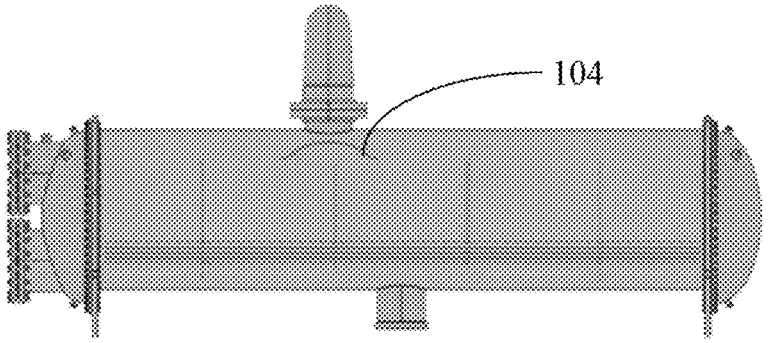
FIG. 5 is a schematic structural diagram of a condenser including the deflector for a condenser in FIG. 3.

As can be seen from FIG. 4 and FIG. 5, the deflector 104 is provided with a deflecting structure projecting toward the inlet 103, to reduce the impact force of the high-temperature high-pressure gas flow from the compressor and alleviate the violent vibration caused in the internal structure of the condenser 101. In addition, the propagation direction of noise generated due to the vibration can be changed by the uneven surface of the deflector 104, and therefore the noise level of the condenser 101 can be effectively reduced. In addition, the deflecting structure is designed as impermeable to the refrigerant gas flow. For example, the deflecting structure does not have any pore.

In the embodiment shown in FIGS. 3 to 5, the deflecting structure is approximately configured as a wavy cross section with peaks and troughs, and at least one peak 110 points to the inlet 103, so that the gas flow entering the condenser 101 can be approximately evenly guided to the trough parts on two sides. Preferably, the deflecting structure is arranged on the entire surface of the deflector 104, so as to provide a better vibration and noise reduction effect. Because the wavy cross section of the deflecting structure increases the circulation area, the deflector 104 makes use of the space inside the condenser 101 to a large extent.

Figure 6:
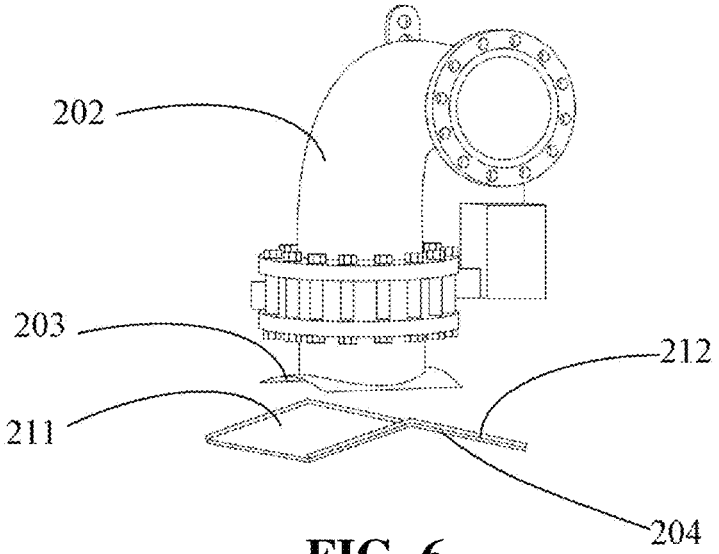
FIG. 6 is a partially-enlarged schematic diagram of a deflector for a condenser according to a second embodiment of the present utility model.
Figure 7:
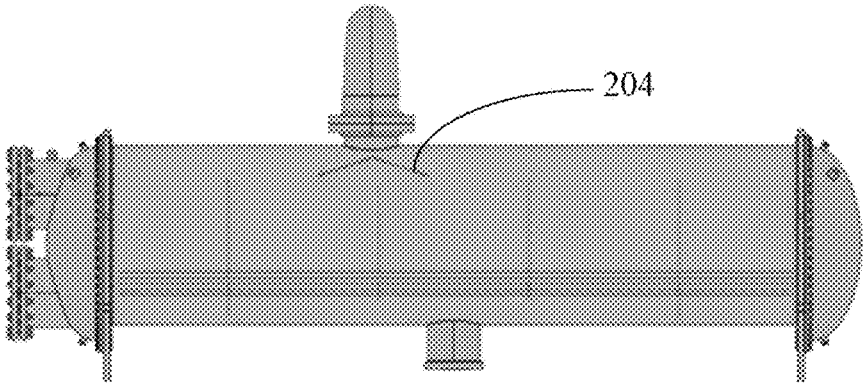
FIG. 7 is a schematic structural diagram of a condenser including the deflector for a condenser in FIG. 6.

FIG. 6 shows a deflector for a condenser according to another specific embodiment of the present utility model. For the position relationship between the inlet 203 of the condenser in communication with the discharge pipe 202 of the compressor and the deflector 204, reference may be made to the description of the foregoing embodiments, and the details will not be repeated herein. As can be clearly seen from FIG. 6 and FIG. 7, in the deflector 204 for a condenser, the deflecting structure has a triangular cross section. Further, the deflecting structure may include a first side plate 211 and a second side plate 212, and the first side plate 211 and the second side plate 212 are of the same size and are symmetrically arranged on the deflector 204 respectively. The top edge formed by the intersection of the first side plate 211 and the second side plate 212 points to the inlet 203. Similarly, after the gas flow entering the condenser reaches the top edge, the gas flow can be approximately evenly guided to the first side plate 211 and the second side plate 212, thus reducing the impact of the high-pressure gas flow on the condenser and reducing noise. Preferably, the deflecting structure is arranged on the entire surface of the deflector 204, so as to provide a better vibration and noise reduction effect. Because the triangular cross section of the deflecting structure increases the circulation area, the deflector 204 makes use of the space inside the condenser to a large extent.

Figure 8:
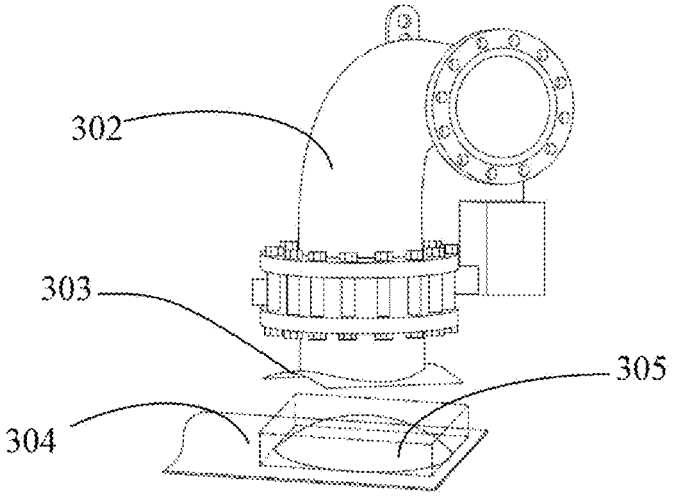
FIG. 8 is a partially-enlarged schematic diagram of a deflector for a condenser according to a third embodiment of the present utility model.
Figure 9:
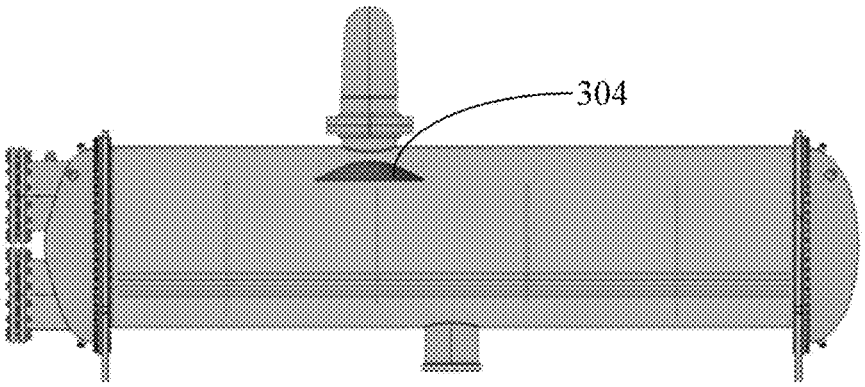
FIG. 9 is a schematic structural diagram of a condenser including the deflector for a condenser in FIG. 8.

FIG. 8 shows a deflector for a condenser according to still another specific embodiment of the present utility model. For the position relationship between the inlet 303 of the condenser in communication with the discharge pipe 302 of the compressor and the deflector 304, reference may be made to the description of the foregoing embodiments, and the details will not be repeated herein. As can be seen from FIG. 8 and FIG. 9, in the deflector 304 for a condenser, the deflecting structure has a truncated spherical cross section 305. The highest point of the spherical cross section 305 faces directly toward the inlet 303. It should be readily understood that because the spherical surface has a larger guiding area than a plane, the deflector 304 for a condenser in this embodiment has a longer guiding path and can better reduce the impact force of the gas flow from the compressor and reduce the noise level of the condenser. Of course, those skilled in the art can also use a deflecting structure having an irregular spherical cross section instead of the above-mentioned strictly regular spherical cross section.

Figure 10:
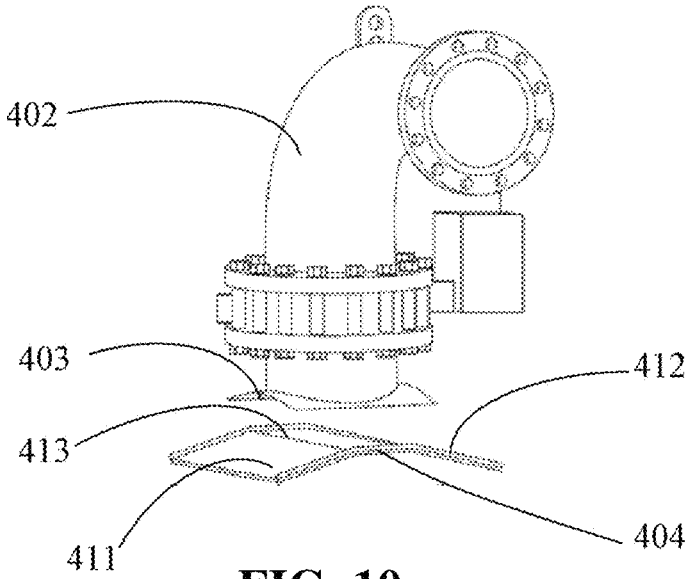
FIG. 10 is a partially-enlarged schematic diagram of a deflector for a condenser according to a fourth embodiment of the present utility model.
Figure 11:
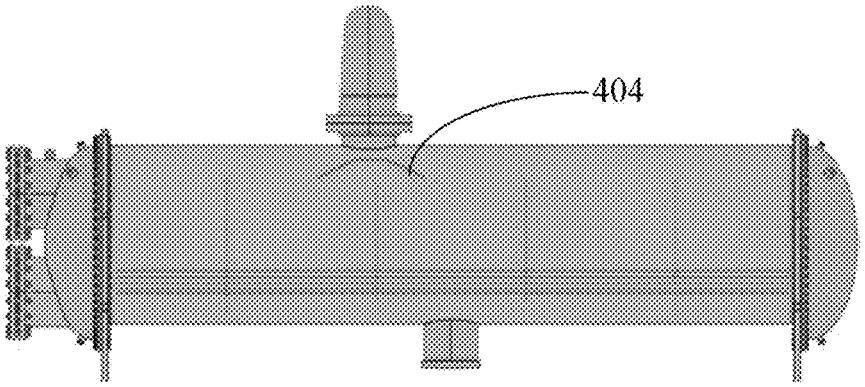
FIG. 11 is a schematic structural diagram of a condenser including the deflector for a condenser in FIG. 10.

FIG. 10 shows a deflector for a condenser according to another specific embodiment of the present utility model. For the position relationship between the inlet 403 of the condenser in communication with the discharge pipe 402 of the compressor and the deflector 404, reference may also be made to the description of the foregoing embodiments. As can be seen from FIG. 10 and FIG. 11, in the deflector 404 for a condenser, the deflecting structure has a trapezoidal section. Further, the deflecting structure may include a first side plate 411, a second side plate 412, and a top plate 413. The top plate 413 faces directly toward the inlet 403, and the first side plate 411 and the second side plate 412 are of the same size and are symmetrically arranged on two sides of the top plate 413. The deflector having such a structure can also reduce the impact force of the gas flow from the compressor and reduce the noise level of the condenser.

As an example, for ease of manufacturing, the deflector and the deflecting structure may be integrally formed. In addition, it can be readily figured out by those skilled in the art that the deflecting structure may also be mounted on the deflector for a condenser as an additional component as long as the manufacturing or processing costs permit.

In addition, the present utility model provides a condenser including the above-mentioned deflector for a condenser. Because the deflector is disposed inside the condenser, the condenser is less likely to generate unexpected noise and vibration during running.

In addition, the present utility model further provides a refrigeration system including the above-mentioned condenser. The refrigeration system includes a cooling tower, a water chilling unit, a pumping device, etc. connected through pipelines. The water chilling unit consists of a compressor, a condenser, a throttle device, an evaporator, and the like. As described above, the condenser including the above-mentioned deflector can effectively achieve the objective of vibration and noise reduction without increasing the costs of the water chilling unit. Therefore, the above-mentioned condenser is suitable for use in various refrigeration systems.

Several specific embodiments are provided above to describe in detail the deflector for a condenser, the condenser including the deflector, and the refrigeration system equipped with the condenser of the present utility model. These examples are only used for describing the principles and implementation manners of the present utility model and are not intended to limit the present utility model. Those of ordinary skill in the art can also make various modifications and improvements without departing from the spirit and scope of the present utility model. For example, to enable the deflector to be able to resist the impact of the gas flow, the deflector may be made of steel or other high-strength materials. Therefore, all equivalent technical solutions shall fall within the scope of the present utility model as defined by the appended claims.

What is claimed is:

1. A deflector for a condenser, wherein the condenser has an inlet in communication with a compressor, and the deflector for guiding a refrigerant gas flow from the compressor is arranged in the condenser and at a position close to the inlet, wherein the deflector is provided with a deflecting structure projecting toward the inlet, and the deflecting structure is configured as impermeable to the refrigerant gas flow;

wherein the deflecting structure includes a truncated spherical cross section.

2. The deflector according to claim 1, wherein the deflecting structure is arranged on the entire surface of the deflector.

3. The deflector according to claim 1, wherein the deflecting structure is made of steel.

4. The deflector according to claim 1, wherein the deflecting structure is fixed to a housing of the condenser by welding.

5. The deflector according to claim 1, wherein a highest point of the deflector faces the inlet.

6. A condenser, comprising:

an inlet in communication with a compressor, and a deflector for guiding a refrigerant gas flow from the compressor arranged in the condenser and at a position close to the inlet, wherein the deflector is provided with a deflecting structure projecting toward the inlet, and the deflecting structure is configured as impermeable to the refrigerant gas flow;

wherein the deflecting structure includes a truncated spherical cross section.

7. A refrigeration system, comprising:

a condenser including:

an inlet in communication with a compressor, and a deflector for guiding a refrigerant gas flow from the compressor arranged in the condenser and at a position close to the inlet, wherein the deflector is provided with a deflecting structure projecting toward the inlet, and the deflecting structure is configured as impermeable to the refrigerant gas flow;

wherein the deflecting structure includes a truncated spherical cross section.

* * * * *